US010653288B2

(12) United States Patent
Batchelor, Jr. et al.

(10) Patent No.: US 10,653,288 B2
(45) Date of Patent: May 19, 2020

(54) TOOL FOR CLEANING FLOORS, WALLS AND INDIVIDUAL ITEMS

(71) Applicants: Jonathan Batchelor, Jr., Miami, FL (US); Scott Voelker, Miami, FL (US)

(72) Inventors: Jonathan Batchelor, Jr., Miami, FL (US); Scott Voelker, Miami, FL (US)

(73) Assignee: Black Tie Brands, LLC, Miami, FL (US)

( * ) Notice: Subject to any disclaimer, the term of this patent is extended or adjusted under 35 U.S.C. 154(b) by 484 days.

(21) Appl. No.: 15/479,015

(22) Filed: Apr. 4, 2017

(65) Prior Publication Data

US 2018/0279848 A1 Oct. 4, 2018

(51) Int. Cl.

| | |
|---|---|
| ***A47L 13/38*** | (2006.01) |
| ***A47L 13/46*** | (2006.01) |
| ***A47L 13/16*** | (2006.01) |
| ***B25G 3/38*** | (2006.01) |
| ***B25G 3/04*** | (2006.01) |
| ***B25G 3/36*** | (2006.01) |

(52) U.S. Cl.
CPC ..... *A47L 13/38* (2013.01); *A47L 13/16* (2013.01); *A47L 13/46* (2013.01); *B25G 3/04* (2013.01); *B25G 3/36* (2013.01); *B25G 3/38* (2013.01)

(58) Field of Classification Search
CPC ..... A47L 13/16; A47L 13/38; A47L 13/46; B25G 3/38
See application file for complete search history.

(56) References Cited

U.S. PATENT DOCUMENTS

| | | | | | |
|---|---|---|---|---|---|
| 2,060,012 | A | | 11/1936 | Baker | |
| 2,062,065 | A | * | 11/1936 | Miley | G10C 9/00 15/210.1 |
| 2,209,275 | A | * | 7/1940 | Lawrence | A47L 13/16 15/210.1 |
| 2,303,660 | A | * | 12/1942 | Mac | A46B 5/00 15/114 |
| 3,066,344 | A | * | 12/1962 | Garcia | A47L 13/38 15/229.3 |
| 5,661,866 | A | * | 9/1997 | Cameron | A47L 13/24 15/147.1 |
| 5,810,408 | A | * | 9/1998 | Armstrong | A01B 1/00 16/422 |
| 6,016,586 | A | * | 1/2000 | Hsu | A46B 5/0075 15/144.1 |
| D435,948 | S | * | 1/2001 | Long | D32/40 |
| 6,182,322 | B1 | * | 2/2001 | Tubman | A46B 7/10 15/144.1 |
| D500,183 | S | * | 12/2004 | Bensussan | D32/40 |
| 7,478,453 | B1 | * | 1/2009 | Busshaus | A47L 13/38 15/144.3 |

(Continued)

FOREIGN PATENT DOCUMENTS

| | | | | |
|---|---|---|---|---|
| EP | 1129658 | A1 * | 9/2001 | A47L 13/24 |

*Primary Examiner* — Marc Carlson
(74) *Attorney, Agent, or Firm* — Mark C. Johnson; Johnson | Dalal

(57) ABSTRACT

A versatile flexible cleaning apparatus including a removable and reusable pad and a core having a central spine. The pad has an opening for insertion or removal of the core. A spacer provides support for the central spine. A connector is a two-part device attachable to a tool, such as the flexible cleaning apparatus, for the addition of a selected handle. A swivel having a locking feature is also attached to the connector. The connector allows for the tool to be quickly and easily converted from a handheld dusting apparatus to a floor mop.

11 Claims, 7 Drawing Sheets

(56) References Cited

U.S. PATENT DOCUMENTS 7,784,141 B2 * 8/2010 Knopow ..... A47L 13/38 15/209.1
8,631,530 B2 * 1/2014 Zita ..... A47L 7/0057 15/1.52
8,756,745 B1 * 6/2014 Feeny ..... A47L 13/252 15/115
2001/0029640 A1 * 10/2001 Cassar ..... A46B 5/0066 15/144.1
2003/0014827 A1 * 1/2003 Gray ..... A47L 13/16 15/222
2004/0177863 A1 * 9/2004 McKay ..... A47L 13/18 134/6
2006/0188317 A1 * 8/2006 Schwarz ..... A46B 3/00 401/123
2006/0260082 A1 * 11/2006 Bonilla ..... A47L 13/38 15/229.3
2007/0180640 A1 * 8/2007 Knopow ..... A46B 5/0025 15/210.1
2009/0025169 A1 * 1/2009 Warning ..... A47L 13/24 15/229.6
2009/0255078 A1 * 10/2009 Wada ..... A46B 7/04 15/209.1
2013/0104326 A1 * 5/2013 Gooden ..... A47L 13/38 15/105
2013/0133150 A1 * 5/2013 Sgroi, Jr. ..... A47L 13/38 15/209.1
2014/0130827 A1 * 5/2014 Dotterman ..... A47L 13/34 134/6
2014/0201936 A1 * 7/2014 Yang ..... A47L 13/38 15/231
2014/0332029 A1 * 11/2014 Thompson ..... B08B 1/002 134/6
2016/0361738 A1 * 12/2016 Wibby ..... B08B 1/006
2017/0251841 A1 * 9/2017 Loos ..... A47C 20/022
2018/0334145 A1 * 11/2018 Voelker ..... B60S 3/042

* cited by examiner

TOOL FOR CLEANING FLOORS, WALLS AND INDIVIDUAL ITEMS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates to a versatile flexible cleaning tool as a handheld tool for dusting or in combination with a handle for dusting items which are elevated or down low, dusting floors and collecting debris found on a flat surface, such as a floor.

BACKGROUND OF THE INVENTION

There is a plethora of devices or tools for dusting items in a room and cleaning a floor, including dusting a floor, and sweeping, or somehow collecting debris, on a floor or flat surface for removal. Most of these tools are limited to a single use, either for off the floor or to use on the floor. They range from inexpensive dusting cloths to expensive powered devices, such as vacuum cleaners.

Dusting around the home, office and car is not a task many, if any, want to do. In fact, most people consider dusting pure drudgery. Dusting takes a lot of time and effort, and this is a chore that has to be done on a regular basis.

Dust is everywhere: on and under furniture, appliances, walls, tops of shelving, light fixtures, window coverings, such as blinds, windowsills, office interiors, car interiors, etc. Dust resides in hard to reach places, including areas we cannot see such as: 1. High places (on top of tall furniture, heating and air conditioning vents, ceiling fans, light fixtures, etc.), 2. Low places (floors, underneath furniture and refrigerators, lower shelves, etc.) and 3. Behind furniture, appliances, shelves, office equipment, and many other objects that are difficult to move.

Most dusting tools either cannot reach the many places dust collects and/or do not have bendable cleaning heads which retain their bent shape for cleaning selected areas, or are too small to clean large surface areas quickly.

Because dusting is a task people don't like doing, dusting usually doesn't occur as frequently as it should.

Many people have dust allergies, making the existence of dust in their homes, offices and cars not only a cleanliness matter, but an important health issue.

SUMMARY OF THE INVENTION

The solution to solving these common dust problems is the versatile flexible cleaning tool of this invention. The tool is an all-in-one handheld flexible duster and can be easily converted to a floor dust mop or extended reach tool. This new cleaning tool is a long, cylindrical-shaped dusting tool completely flexible in all directions. It is constructed with a removable colorful microfiber or wool cleaning pad that allows users to easily cover more surface area in less time, and in more hard to reach places, than any other dusting tool on the market. Users can grab and hold the tool anywhere throughout its entire length, or add a handle when desired. The tool is either a handheld flexible dusting tool or a combination tool with a handle for reaching many surfaces, high, low and on the floor. The long reach of the combination can eliminate the need to use a stool, chair or stepladder for that hard to reach dust.

Not only does this tool dust both the typical and hard to reach places, but the tool also easily converts to a convenient floor dust mop with the attachment of a long handle. This feature allows users to dust everything from hard surface floors, to walls and ceilings and everything in between. The tool is like having multiple dusting tools in one. Additionally, this tool is perfect for dusting cars, SUVs and recreational vehicles.

The cleaning pad of the tool fits like a sleeve around a flexible core comprised of a rigid, but easily bent, spine or backbone embedded within a soft closed cell foam, unlike other dusters with wooden or plastic handles. The entire length of the tool and 360 degrees of its surface area can be used for cleaning. One of the many factors that makes this dusting tool unique is that it can be easily converted to a floor dusting mop with the attachment of a long handle. Additionally, various handle types and lengths can be attached to complete selected cleaning tasks, and it is flexible in all directions. The unique tool design is not only a very effective and efficient dusting tool, but it also appeals to children, as well. Colorful pads of one color, or of a plurality of colors, may be used to make the tool with a fluffy pad resemble a Wooly Worm caterpillar. This feature can encourage children to use it to clean their own rooms and around the house.

The tool is very useful with dimensions of approximately 30 inches in length by approximately 9 inches in circumference to form a cylindrical shaped device which may be effectively used when held in a hand. The handheld tool is comprised of two main components: 1. The cleaning or dusting pad and 2. The core, comprised of a spine or backbone and the foam which encases the spine to support the pad. The length and/or circumference of the cylindrical shaped device may be different to fit selected dusting or cleaning applications. Although a cylindrical shape is preferable, the shape may be other than cylindrical.

The tool's usefulness is increased by the addition of a handle either along the length of the pad or at the end of the cylindrical device. This combination of a handheld tool and an attachable handle is unique.

The cleaning or dusting pad has multiple options for its cleaning surface materials, referred herein as the cleaning pad, cover or sleeve. Although there are different options for the cleaning pad, each material option removes dust. The cleaning pad may be comprised of, or coated with, materials that attract or hold on to dust particles. Preferred options for the cleaning pads are a chenille microfiber "anemone" surface material (referred throughout as "microfiber"). The preferred microfiber material has anemone tentacles or fingers about 1 in. in length and about ¼ in. in thickness, although this could vary. Alternatively, the pad may be made from a natural long fiber wool. The wool offers a fluffy and natural alternative to the microfiber material. These cleaning pads may be available in various bright and attractive colors, with each tool potentially designed with multiple colors.

The cleaning pad cover is removable and reusable, so it can be taken off for washing, and then put back on, or the cleaning pad can be replaced by a different cleaning pad for another cleaning purpose.

The tool may have a fluffy wide color band, like orange and brown or black. The tool may have various bright and attractive colors, to be eye catching on store shelves, as well as attractive to children, so that they want their parents to buy them. The colors allow for usage differentiation.

The core of the tool supports the cleaning pad. The core consists of a spine and the spacer of foam in which the spine is embedded. The core forms the body or shape of the tool. The spine may be comprised of a thick metal wire, a flexible tube, and/or other materials engineered to be flexible in all directions. The core of spine and foam retains the bent shape and can be bent repeatedly without breaking or becoming weak. The foam in which the spine is embedded is a closed cell foam material and provides support for the spine and provides the shape and body on which the cleaning pad is placed. This foam also acts as a spacer to prevent the spine from kinking when being bent into the desired positions. Further the thickness of the foam is determined by the diameter of the spine and the desired diameter of the tool.

The spine of metal and/or plastic engineered material acts like the vertebra found in a backbone. It provides the strength, the flexibility and the ability to form and retain the user created shapes and configurations of the duster over its entire length. Each spine is made of material, or materials, or structures, such that they are lightweight, but strong, and can be bent with little effort.

A flexible thick wire or rod made up of a non-rusting, flexible metal wire or thin rod that is easy to manipulate and bend into whatever shape desired. Also, the wire or rod is rigid enough to maintain the overall shape desired while the user cleans the objects and/or areas. This wire or rod has the molecular qualities such that it allows the user to bend the wire into any shape, and can be bent over and over without breaking or becoming weak. This spine can be embedded within a closed cell foam material, along its length, to form the body of the tool. The foam helps the tool keep the selected shape while the tool is being used. The foam keeps the spine from kinking or bending at such a tight angle that it could break.

Alternatively, the spine may be a flexible hose spine made up of interlocking contiguous plastic or non-rusting metal pieces, like a ball and socket. These interlocking pieces form a flexible hose or tube which may be easily manipulated into a desired shape, such as a circle, an "L", a semicircle, or the shape of an object to be cleaned. The friction between the interlocking pieces firmly holds the selected shape while the user of the tool cleans selected objects and/or areas. This spine can be embedded within a closed cell foam material, along its length, to form the body of the tool. The foam helps the tool keep the selected shape while the tool is being used. The foam keeps the spine from kinking or bending at such a tight angle that it could break.

The foam is preferably a closed cell foam so that it does not absorb moisture or liquids. This allows the user to clean in a wet environment and not have the foam absorb moisture and get heavy and take long time to dry out completely. The thickness of the foam is determined by the diameter of the wire or rod and the desired circumference of the tool.

As a result of the size, shape and handle options, the tool offers a large cleaning surface area and great flexibility. The attachment of one of many types of handles allows users to dust their floors, or clean hard to reach high areas such as ceiling fans, ductwork vents, light fixtures, walls or ceilings, or low areas such as under furniture or alongside or behind large immovable objects like refrigerators, washer/dryers, or office equipment.

There are two types of handle connector attachments described herein: an external adjustable connector on the exterior of the pad, or EAC, and a fixed placement integrated connector, or FPIC. Each allows for a handle to be easily and quickly fixed to the tool. The connectors can have a swivel adapter between the tool and the handle, allowing the relative angle between the tool and the handle to change as needed.

The EAC for the handle attaches to the exterior of the pad via a strong elastic band, and thus allows the handle to be attached in various areas along the body instead of in a fixed position. The EAC has three parts. The first part is the elastic band that wraps around the exterior of the cleaning pad to secure the connector in place on the tool. The second part, or base, or hub, of the connector is where the elastic band is attached. This base/hub has a third part: a female screw-in or quick release opening perpendicular to the spine where the male handle counterpart resides. This handle attachment point allows for the attachment of long or short handles. The third part also has a swivel or hinge that allows the handle to pivot and swing freely, as well as a locking mechanism to achieve a fixed angle between the handle and the tool. This mechanism allows the handle to remain in a fixed position when desired. The swivel attachment is ideal for attaching a long handle for dusting floors.

The FPIC connectors can be a screw-in or quick release device integrated or attached at the midpoint of the spine and at the end. The connector at the midpoint creates a hub from which the spine is attached (or molded into), and from where the spine extends out laterally from the opposite side of the hub to form the long body of the tool. This base or hub includes the female opening to which the male end of the handle or swivel adapter is inserted. If the swivel adapter is inserted, it allows the handle to pivot in various directions. Within the swivel adapter is a threaded female connector for the handle. Long or short handles may be attached. The cleaning pad or cover has flaps or openings through which the handle or swivel adapter passes. When the handle or swivel adapter connector is not installed, the openings are closed and not visible. The swivel adapter has a locking feature so that the handle can freely swivel or it can be locked in a 45 degree or 90 degree position or some other position. This locking functionality of the swivel provides a selected fixed position for the handle relative to the pad. The swivel is ideal for attaching a long handle for dusting floors. Some handle attachments are screw-in type attachment points. The female threaded parts are based on standard threading commonly found on most broom handles, mop handles, paint roller handles, etc.

In order to remove and to put on the pad or cover, there are various options for opening the cover and sealing the cover closed. Snap closures are ideal for this purpose.

The snaps may be concealed underneath a flap on the end of the tool, and not be in direct contact with the items being dusted to avoid scratching said items. The snap materials used are rustproof.

When the tool is configured with an FPIC for the handle attachment, snaps or a hook-and-loop fastener allows the cleaning pad to be opened and closed for attachment of the handle when needed. The cleaning pad has an opening and snaps to allow the pad to be sealed closed on both sides of the handle connector leaving only access for the handle exposed. A further means is a hook-and-loop fastener which allows the pad opening to be opened and closed rather easily.

The hook-and-loop fastener is sufficiently flexible so that the flexibility and shape of the spine does not interfere with the closing effectiveness of the hook-and-loop fastener.

The tool, when 30 inches long and 9 inches in circumference, has over 270 square inches of cleaning surface. The total surface area that can pick up dust is appreciable. The tool is comfortable to hold and has an ergonomic shape and is lightweight to reduce hand, wrist and arm fatigue. For both versions of the tool, the type of handle and length depends on the planned use of the tool. For example, if the user wants to dust a hard surface floor, a long handle can be easily attached to convert the tool into a flexible floor dust mop.

The above features can be better understood from the following detailed description and with reference to the drawings below.

DETAILED DESCRIPTION OF THE PREFERRED EMBODIMENTS

Figure 1:
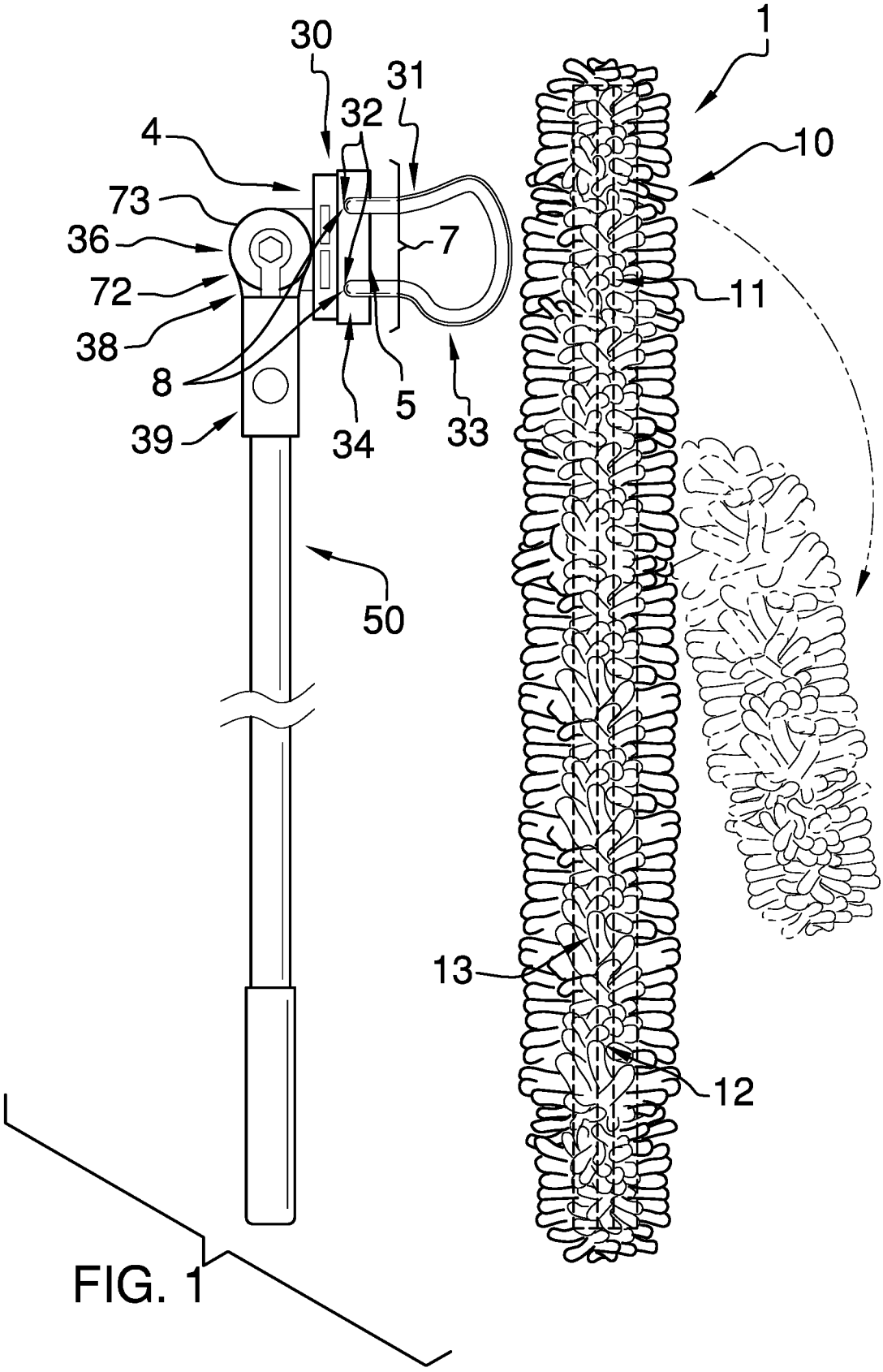
FIG. 1 is a top plan view of the handheld tool, with the spine and foam, which form the core, in phantom, as well as the external attachable connector and an attached handle.
Figure 2:
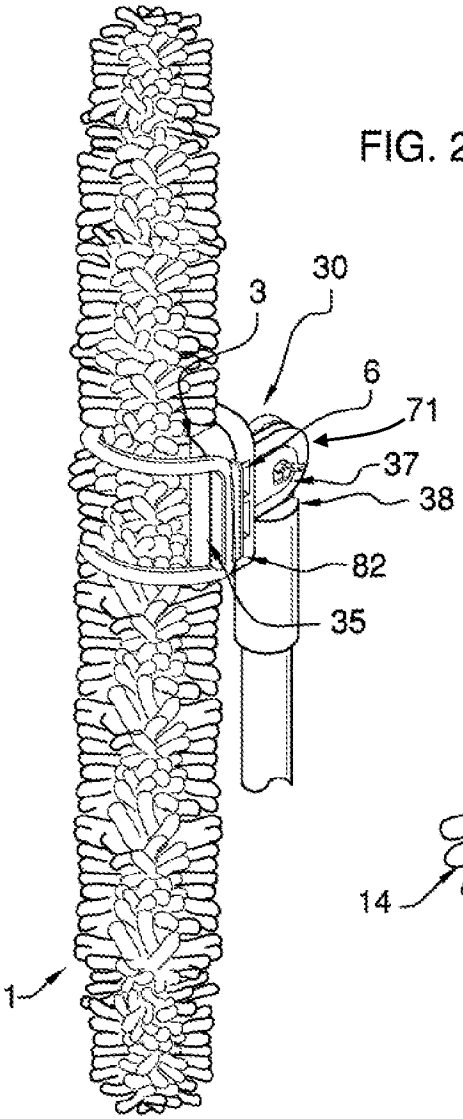
FIG. 2 is an isometric view of the tool with the external attachable connector and an attached handle.
Figure 3:
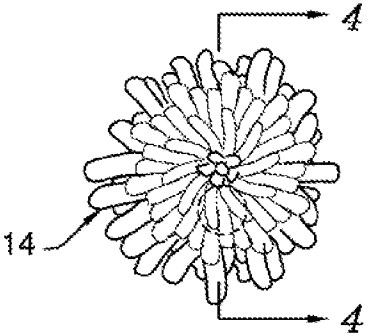
FIG. 3 is a side elevation view of the tool cover with the snap shown in phantom.
Figure 4:
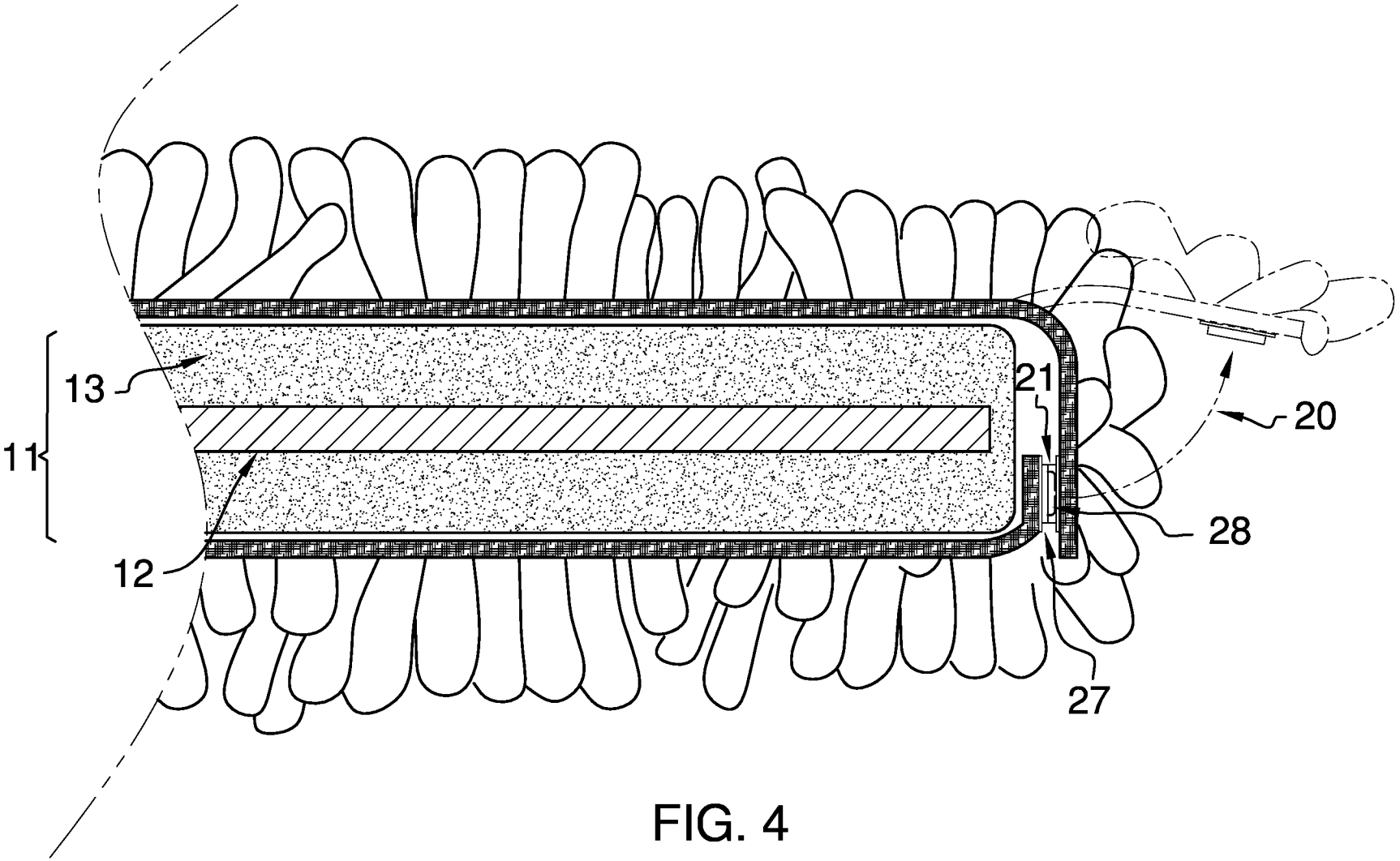
FIG. 4 is a cross-sectional view from the side of a portion of the handheld tool, along the 4-4 line of FIG. 3.
Figure 5:
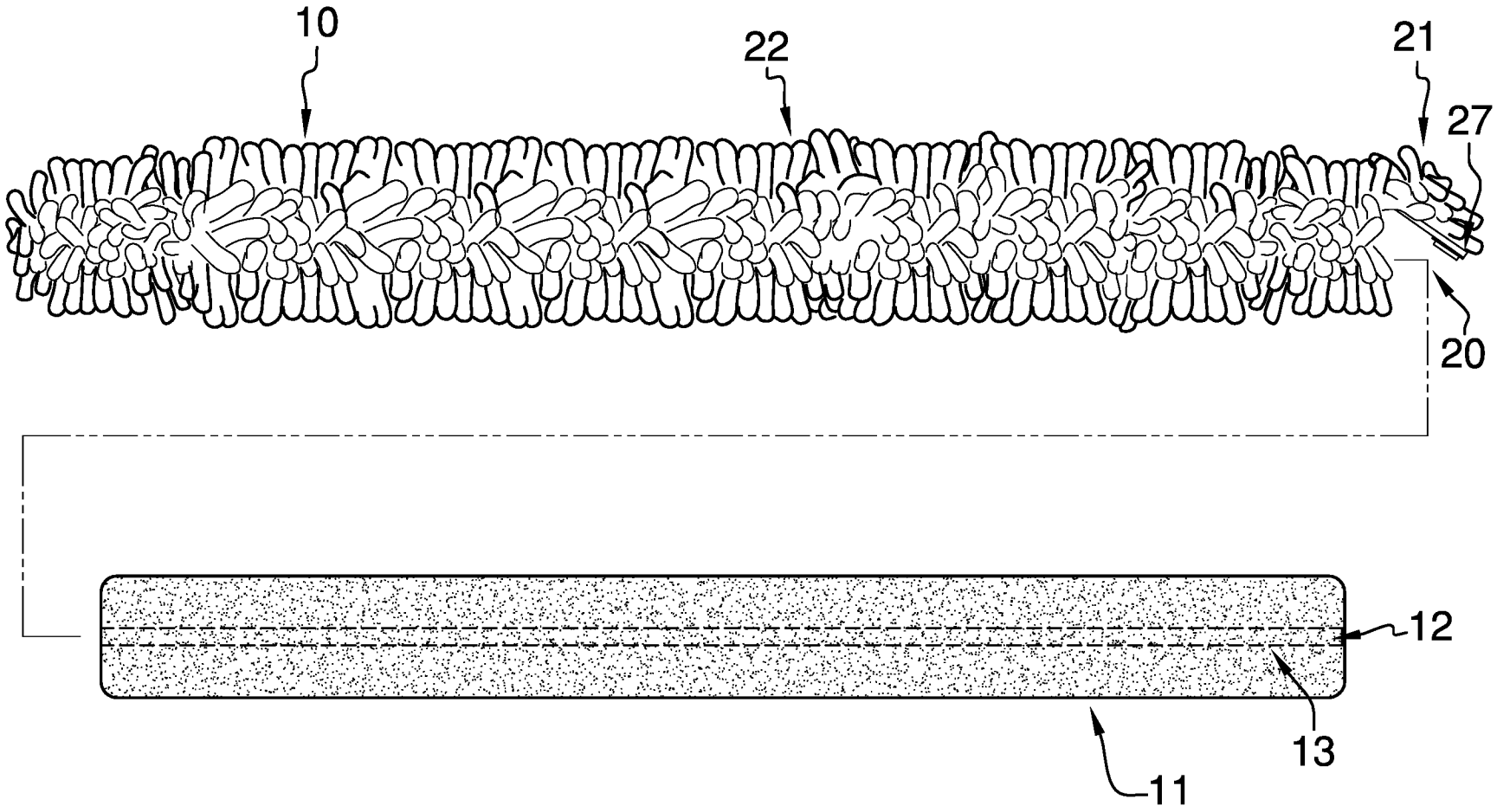
FIG. 5 is a front elevation exploded view of the handheld tool showing the tool cover with an opening and a snap closure, and the core with the spine shown in phantom.
Figure 6:
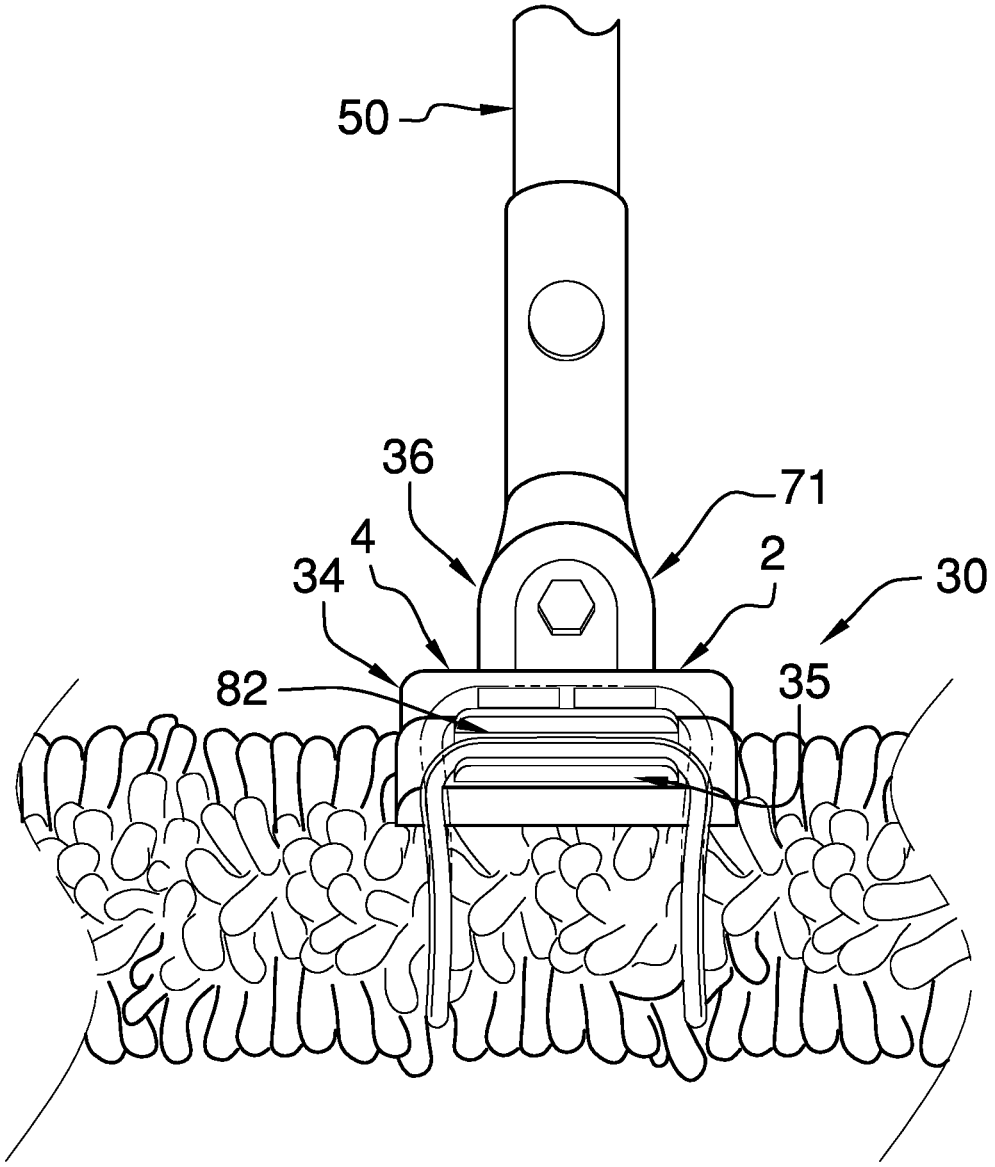
FIG. 6 is a front elevation view of a portion of the tool with the external attachable connector and an attached a handle.
Figure 8:
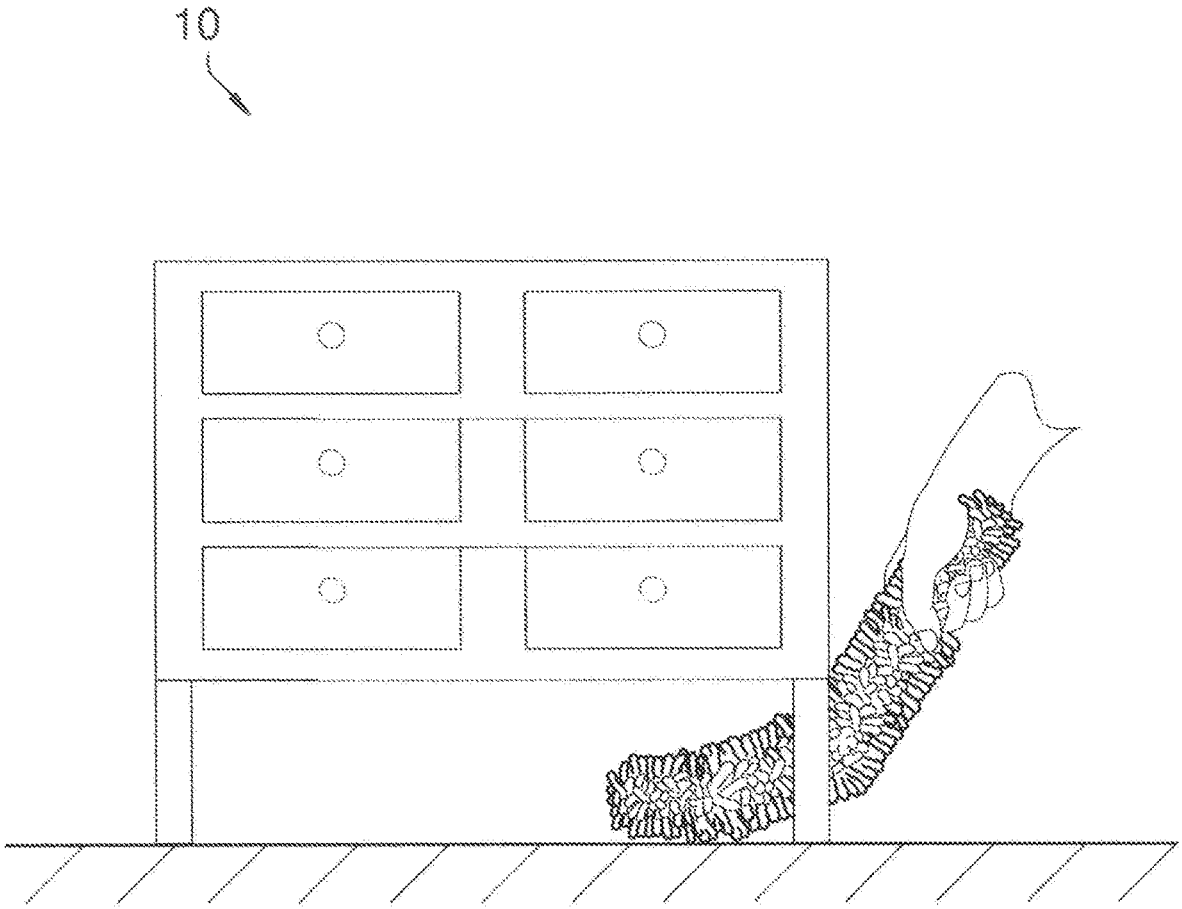
FIG. 8 is an isometric view of the handheld tool bent for a particular dusting task under a low piece of furniture.

A handheld dusting tool 1 of this invention is shown as a standalone tool in FIGS. 3, 4 and 5, and in use in FIG. 8.

The combination of the handheld dusting tool 1 and a handle attachment or connector 30 or 60 with a handle 50 is shown in FIGS. 1, 2, 6, and 7.

As a result of the size, shape and handle options, the tool offers the most cleaning surface area available and the most flexibility of any cleaning or dusting tool on the market. The attachment of one of many types of handles allows users to dust their floors, or clean hard to reach high areas such as ceiling fans, ductwork vents, light fixtures, walls or ceilings, or low areas such as floors, under furniture, or alongside or behind large immovable objects like refrigerators, washer/dryers, or office equipment.

One of the most unique aspects and advantages of this dusting tool is an attachment mechanism that allows for a plurality of handles to be attached at any point along the apparatus. That is, if a user wants to have an extended reach, various types of handles can be quickly and easily attached, and if the user wants to dust a low surface, such as floors, a long handle can be attached to quickly convert the duster into a flexible floor dust mop. Without a handle, users can grab and hold the tool anywhere throughout its entire length, or add a handle when desired.

The tool 1 consists of a cover or a pad 10 and a core 11. The core has a central spine 12 and may have a foam spacer 13, in which a spine 12 is embedded when the spacer 13 is present.

The cleaning or dusting pad 10 has multiple options for its cleaning surface materials. Although there are different options for the cleaning pad 10, each material option removes dust. The cleaning pad 10 may be comprised of, or coated with, materials that attract and/or hold on to dust particles. The cleaning pad 10 is made of a chenille microfiber "anemone" surface material or "microfiber". The microfiber material has anemone tentacles or fingers 14 about 1 inch in length and about ¼ inch in thickness. The length and thickness may be different if desired. Alternatively, the pad is made from a natural long fiber wool. The wool is a fluffy and natural alternative to the microfiber material. This cleaning pad 10 may have bright and attractive colors, with each tool potentially designed with multiple colors. Also, preferably, the cleaning pad 10 is in the shape of a sleeve as a cover that fits over the flexible core 11, which allows it to be shaped as the user desires.

The pad 10 is removable and reusable, so it can be taken off for washing, and then put back on. Alternatively, the cleaning pad 10 can be replaced by a different cleaning pad for another cleaning purpose.

The tool, when 30 inches long and 9 inches in circumference, has over 270 square inches of cleaning surface. The entire length of the tool and 360 degrees of its surface area can be used for cleaning. The total surface area that can pick up dust is appreciable.

The size of the tool is determined by the use of the tool. For most uses, the tool is 30 inches long and has a 9 inch circumference for its cylindrical shape. The tool may be shorter for small areas to be dusted, such as in a vehicle, and smaller for use by children.

The handheld tool is comfortable to hold and has an ergonomic shape and is lightweight to reduce hand, wrist and arm fatigue.

The spacer 13, in which the spine is embedded, is a closed cell foam material and provides support for the spine 12 and provides the shape and body on which the cleaning pad 10 is placed. This foam acts as a spacer to prevent the spine 12 from kinking when being bent into the desired positions. Furthermore, the thickness of the foam is determined by the diameter of the spine and the desired diameter of the tool.

The foam is preferably a closed cell foam so that it does not absorb moisture or liquids. This allows the user to clean in a wet environment and not have the foam absorb moisture and get heavy and take long time to dry.

The spine may be comprised of a thick metal wire, or a flexible tube, and/or other materials engineered to be flexible in all directions. The core 11 comprised of the spine 12 and spacer foam 13 retains the bent shape and can be bent repeatedly without breaking or becoming weak. The spine of metal and/or plastic engineered material acts like the vertebra found in a backbone. It provides the strength, the flexibility and the ability to form and retain the user created shapes and configurations of the duster over its entire length. Each spine is made of material, or materials, or structures, such that they are lightweight, but strong, and can be bent with little effort.

The spine 12 is a solid wire or rod piece, or the spine may be a flexible hose 15 made up of interlocking contiguous plastic or non-rusting metal pieces, like a ball and socket. These interlocking pieces form a flexible hose or tube, which may be easily manipulated into a desired shape, such as a circle, an "L", a semicircle, or the shape of an object to be cleaned. The friction between the interlocking pieces firmly holds the selected shape of the spine while the user of the tool cleans selected objects and/or areas.

The pad 10 has an opening 20 for the insertion or removal of the core 11. The opening 20 will be at an end of the pad 10.

In order to separate the core 11 and pad 10 to put on or remove the pad or cover 10, an option for opening the cover and sealing the cover closed is snaps or, alternatively, a hook-and-loop fastener.

A plurality of snaps 27, like the single snap 27 seen in FIG. 4, may be used in place of a single snap, and spaced along the opening near an end 21, or at the middle of the pad 22. One part 28 of a snap is attached to the outermost overlapping layer of the cover opening, facing towards the spine. The underlapping layer of the cover opening carries the cooperating part 29 of the snap. The snaps are concealed and not in direct contact with the items being dusted, thus avoiding the scratching of the furniture surfaces.

An external adjustable connector 30 for the handle 50 has a U-shaped hub 34 having an outside 2, an inside 3, a top 4, a near side 5, a far side 6, a length 7 and a pair of holes 8. Each of the near side and the far side have an equal length, and the pair of holes is disposed along the length of the near side from the outside to the inside.

At least one lip 35 is disposed to the outside of the U-shaped hub on the far side. The at least one lip is disposed parallel to the length of the far side of the hub.

The external adjustable connector attaches to the pad 10 with a strong elastic band 31. The band 31 has a pair of ends 32, with each of the pair of ends disposed in each of the pair of holes 8 disposed in the hub 34 to form a stretchable elastic band loop 33 wrappable around the outer circumference of the pad 10 and hookable onto the at least one lip 35. The external adjustable connector 30 allows the handle to be attached in various areas along the body of the handheld tool instead of in one area. The band 31 is manually stretched to place the loop 33 on, and secured by, the lip 35. A second lip 82, and possibly a third lip, are adjacent to the lip 35 in order to further stretch and secure the band 31 if tightening is required. A swivel or hinge 36 has a proximal section 71, a lockable pivot mechanism 37, a distal section 72, and a threaded female connector 39. The proximal section 71 is disposed to the outside 2 of the top 4 of the hub 34 to permit an angular adjustment of the position of the handle relative to the handheld tool. The lockable pivot mechanism 37 allows the handle to freely swivel or to be locked in a selected position. This locking functionality of the swivel point provides a fixed position for the handle relative to the pad. The swivel attachment is ideal for attaching a long handle for dusting floors. The distal section 72 of the swivel 36 has a pivot end 73 and a distal end 38 having the threaded female connector 39, the pivot end 73 proximal the pivot mechanism 37, and the distal end 38 opposite the pivot end. The threaded female connector 39 has internal female threads 40 selectively engageable to a male threaded end 41 of a handle 50. This is the threading commonly found on most broom handles, mop handles, paint roller handles, etc. This allows for the attachment of long or short handles.

Figure 7:
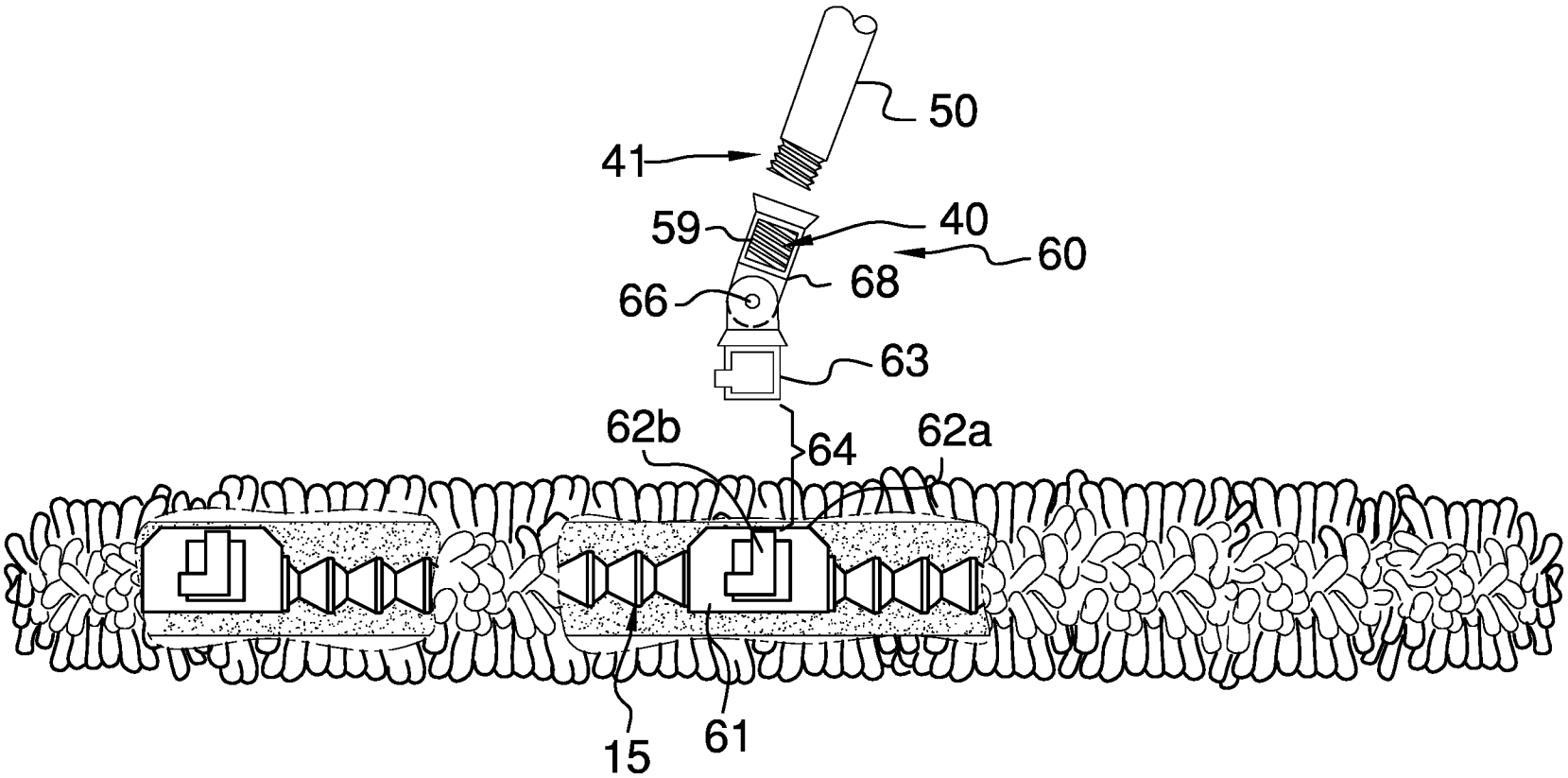
FIG. 7 is a side view of the tool showing the interior of the tool with the fixed placement integrated connector.

An alternative to the external adjustable connector would be a fixed placement integrated connector 60, shown in FIG. 7. The fixed placement integrated connector is attached to or formed with the spine 15 directly at the midpoint of the spine for the addition of a selected handle. The fixed placement integrated connector has a base 61 which creates a hub attached to, or molded into, the spine 15. Attached to the base 61 is the male portion 62*a* of a quick release connector 64.

The base or hub 61 has a female connector opening 62*b* perpendicular to the spine below an opening in the pad to allow for the insertion of the male quick release part 63. At the end opposite to where the female part mates with the male part a swivel 66 attaches, as in the external adjustable connector 30. At the end 68 of the swivel 66, a female connector 69 for the handle is attached. The female connector 69 has internal threads 40 to receive the male threaded end 41 of typical threaded handles.

When the tool has a fixed placement integrated connector 60, as shown in FIG. 7, for the handle 50, an opening in the cover with a snap allows the handle to be inserted through the cover and onto the core. Hook-and-loop fastener may also be used in place of the snaps 27.

FIG. 8 shows one use of the handheld tool bent to reach under low furniture placed on the floor.

What is claimed is:

1. A dusting apparatus comprising:

a bendable support spine with a first end, a second end opposing the first end of the bendable support spine, and a spine length separating the first and second ends of the bendable support spine, the bendable support spine operably configured to have a selected bent position;

a cylindrical core disposed around the bendable support spine and spanning the spine length;

a cover disposed around the core, spanning the spine length, having a terminal first end, a terminal second end opposing the terminal first end, and a cover length separating the terminal first and second ends, wherein the cover is of a material substantially spanning the cover length and configured to collect and retain dust, and the cover completely encapsulating the core and the bendable support spine and with the first terminal end operably configured to selectively open to define an opening for receiving or removing the core;

a plurality of snaps selectively positioned proximal to the opening, wherein the plurality of snaps is configured to snap together to completely encapsulate the core and the bendable support spine; and a connector with a handle coupled thereto, the connector operably configured to surround, slide along, and attach to an outer surface of the cover along any point of the cover length.

2. The dusting apparatus according to claim 1, wherein the connector further comprises:

an opening defined thereon and with the cover material passing therethrough.

3. The dusting apparatus according to claim 2, wherein the connector further comprises:

an elastic band, defining the opening of the connector, and partially surrounding the cover to form a band loop.

4. The dusting apparatus according to claim 3, wherein:

the elastic band of the connector includes an end operably configured to selectively and directly couple and uncouple to a lip defined on a hub of the connector.

5. The dusting apparatus according to claim 1, wherein:

the connector is pivotably coupled to the handle and operably configured to selectively swivel and lock with respect to handle, thereby providing angular adjustment of the cover when coupled to the connector.

6. A dusting apparatus comprising:

a bendable support spine with a first end, a second end opposing the first end of the bendable support spine, and a spine length separating the first and second ends of the bendable support spine, the bendable support spine operably configured to have a selectively bent and retained positions;

a cylindrical core disposed around the bendable support spine and spanning the spine length;

a cover disposed around the core, spanning the spine length, having a terminal first end, having a terminal second end opposing the terminal first end, having a cover length separating the terminal first and second ends, of a material substantially spanning the cover length and configured to collect and retain dust, the cover encapsulating the core and the bendable support spine; and a connector with a handle coupled thereto, the connector operably configured to surround, slide along, and attach to an outer surface of the cover along any point of the cover length.

7. The dusting apparatus according to claim 6, further comprising:

an opening defined by the first terminal end of the cover, the first terminal end of the cover operably configured to selectively open to define the opening for receiving or removing the core; and at least one fastener positioned proximal to the opening defined by the and operably configured to fasten and encapsulate the core and the bendable support spine.

8. The dusting apparatus according to claim 7, wherein the connector further comprises:

an opening defined thereon and with the cover material passing therethrough.

9. The dusting apparatus according to claim 8, wherein the connector further comprises:

an elastic band, defining the opening of the connector, and partially surrounding the cover to form a band loop.

10. The dusting apparatus according to claim 9, wherein:

the elastic band of the connector includes an end operably configured to selectively and directly couple and uncouple to a lip defined on a hub of the connector.

11. The dusting apparatus according to claim 10, wherein:

the connector is pivotably coupled to the handle and operably configured to selectively swivel and lock with respect to handle, thereby providing angular adjustment of the cover when coupled to the connector.

* * * * *